United States Patent [19]

Jekerle

[11] Patent Number: 4,993,479

[45] Date of Patent: Feb. 19, 1991

[54] HEAT EXCHANGERS

[75] Inventor: Jiri Jekerle, Baunatal/Altenritte, Fed. Rep. of Germany

[73] Assignee: Schmidt'sche Heissdampf GmbH, Kassel-Bettenhausen, Fed. Rep. of Germany

[21] Appl. No.: 560,171

[22] Filed: Jul. 31, 1990

Related U.S. Application Data

[63] Continuation of Ser. No. 269,797, Nov. 10, 1988

[30] Foreign Application Priority Data

Nov. 14, 1987 [DE] Fed. Rep. of Germany ..... 3738727

[51] Int. Cl.[5] ..... F28F 27/00

[52] U.S. Cl. ..... 165/1; 165/40; 165/96; 165/154

[58] Field of Search ..... 165/1, 40, 96, 154

[56] References Cited

U.S. PATENT DOCUMENTS

| | | | |
|---|---|---|---|
| 2,910,276 | 10/1959 | Escher | 165/96 |
| 3,493,041 | 2/1970 | Hourwitz et al. | 165/147 |
| 3,626,672 | 12/1971 | Burbidge | 165/96 X |

FOREIGN PATENT DOCUMENTS

| | | | |
|---|---|---|---|
| 80812 | 7/1931 | Sweden | 165/96 |

*Primary Examiner*—Stephen M. Hepperle
*Assistant Examiner*—Allen J. Flanigan
*Attorney, Agent, or Firm*—Chilton, Alix & Van Kirk

[57] ABSTRACT

A heat exchanger having coaxial inner and outer conduits is characterized by a flow intercepting body which extends into the inner conduit to thereby divide the length of the heat exchanger into two sections with different heat exchange characteristics. Adjustment of the temperature of gases exiting the heat exchanger may be accomplished by varying the ratio of the lengths of the two sections of the heat exchanger.

12 Claims, 2 Drawing Sheets

HEAT EXCHANGERS

This is a continuation of co-pending application Ser. No. 269,797 filed on Nov. 10, 1988 now abandoned.

BACKGROUND OF THE INVENTION (1) Field of the Invention

The present invention relates to the exchange of thermal energy between flowing fluids and particularly to the cooling of process gases such as those used during the thermic cracking of gaseous and liquid hydrocarbons. More specifically, this invention is directed to heat exchangers and especially to devices of such character which define generally coaxial isolated flow paths for a pair of fluids. Accordingly, the general objects of the present invention are to provide novel and improved methods and apparatus of such character.

(2) Description of the prior art

Heat exchangers of the "double pipe" type, i.e., thermal energy transfer devices comprising at least one inner pipe and one outer pipe, are known in the art. In such heat exchangers, an example of which is enclosed in published German patent application No. 24 12 421, the medium to be cooled will typically flow through the inner pipe while the outer pipe, which is coaxial therewith and thus defines an annular flow path, has a cooling water-steam mixture passed therethrough. One or both pipes of the heat exchanger may be connected, at first ends, to a collector which has inner and outer chambers.

Heat exchangers of the type generally described above are used for the cooling of process gases, especially gases resulting from the thermic cracking of gaseous and liquid hydrocarbons. The cooling of such process gases is an important step in the production of ethyls and propyls. The stabilizing of the products of separation after the splitting process, which is directly related to the yield from the process, can only be achieved through the quick cooling of the gases. The requisite cooling requires that the velocity of the gases passing through the heat exchanger be relatively high and, of course, that there be very good transfer of heat, over the heating surface of the exchanger, from the process gas to the coolant.

An impediment to maximizing the efficiency of a thermic cracking process resides in the fact that particles of coke are formed during cooling of the cracked gases as a result of condensation of the simmering fractions of the hydrocarbon mixture. These coke particles are deposited on the walls of the heat exchanger partly because of the turbulence in the high velocity flow and also because of the existence of large temperature gradients across the heat exchanger cross-section. Such deposits reduce the heat exchange efficiency. The resultant rise in the process gas exit temperature has a negative effect on the entire production operation.

It has been common practice in the art to design "double pipe" heat exchangers, and particularly to size such devices, to achieve acceptable process gas exit temperature with moderate contamination of the walls of the pipe through which the process gas is flowing. Once the process gas exit temperature exceeds the acceptable level as a result of dirt accumulation on the pipe wall, the heat exchanger must be cleaned. The removal of the heat exchanger from service for cleaning dictates a loss of production and, consequently, is a very costly procedure.

SUMMARY OF THE INVENTION

The present invention overcomes the above-briefly discussed and other deficiencies and disadvantages of the prior art and, in so doing, provides a novel and improved heat exchanger characterized by significantly increased operational time between cleanings and by the ability to maintain the gas exit temperature at a nearly constant level during the operating interval between cleanings. The present invention also encompasses a mode of operation which enables the above-stated improved operational characteristics to be achieved.

Apparatus in accordance with the invention comprises a "double pipe" heat exchanger wherein the inner pipe is provided with means for selecting the heat exchange characteristics of at least a portion of the heat exchanger. This heat exchanger characteristic selecting means comprises a flow intercepting body which is positioned coaxially with respect to the inner and outer pipes of the heat exchanger. The flow intercepting body reduces the effective cross-sectional area of the inner pipe thereby increasing the velocity of flow in the region occupied by the body, and cooperates with a portion of the inner pipe to define a restricted flow path of annular shape along a substantial portion of the heat exchange path length.

In one embodiment of the invention, the flow intercepting body is of generally elongated cylindrical shape and may be moved axially with respect to the inner pipe of the heat exchanger, by an externally positioned mechanical drive. The flow intercepting body is also shaped, at its upstream facing end, so as to minimize its effect on the dynamics of the gas flowing through the pipe in which it is located.

The free flow intercepting body, as noted above, decreases the cross-sectional area of the inner pipe of the heat exchanger through which the hot process gas flows. This reduction in pipe cross-section results in higher velocity flow and the smaller width of the flow path between the wall of the inner pipe and the flow intercepting body substantially increases the convective heat transfer from the gas to the pipe and thus to the coolant. Restated, the increase in gas velocity results in an increase in the Reynolds number for that section of the pipe which is occupied by the flow intercepting body and, as is well known, the heat transfer from the flowing fluid increases with the Reynolds number. In addition to heat transfer because of convection in that section of the inner pipe in which the flow intercepting body is located, enhanced heat transfer also occurs because of the solid body radiator, i.e., the flow intercepting body. Thus, the flow intercepting body also acts as a heat radiator or sink.

The magnitude of the local temperature gradient in the laminar border layer of the gas flow has a significant influence on the deposition of coke particles on the pipe wall. The presence of the flow intercepting body increases the thermal energy transfer without noticeable influence on the temperature gradient in the laminar border layer. Accordingly, the process of coking occurs more slowly than in the case of a comparatively higher convective heat transfer. This factor increases the interval between required cleanings of the heat exchanger.

The presence of the flow intercepting body in the inner pipe of the heat exchanger divides the total length of the device which is effective for heat transfer into two adjacent longitudinal sections with different levels of gas side heat transfer. The axial repositioning of the flow intercepting body, or the substitution of a flow intercepting body of different length, enables the exercise of control over the total energy transfer between the hot process gas and the coaxially flowing coolant. This, in turn, permits the gas exit temperature to be maintained at a nearly constant level. In the case of a flow intercepting body which can be moved axially, the gas exit temperature may be automatically regulated by means of sensing temperature and employing the sensed temperature to control the drive mechanism for the flow intercepting body.

In a heat exchanger in accordance with the invention, the heating surface is proportioned in such a manner that the desired gas temperature is obtained under clean conditions with the flow intercepting body at a retracted or upper end position, i.e., with the minimum length of the flow intercepting body inserted in the gas stream. During operation, as a function of the increase in gas-side dirt accumulation, the length of the flow intercepting body which is inserted into the gas flow is increased as needed to maintain the desired gas exit temperature.

In the manner described above, the gas exit temperature in a heat exchanger in accordance with the invention may be held substantially constant during the entire operational time between successive cleanings.

An important feature of the present invention is the discovery of the adjustability of the gas exit temperature by means of the use of a coaxial flow intercepting body. This discovery permits the choice of stock to be split to be varied. Restated, the heat exchanger of the present invention affords flexibility in the cooling step and thus allows a thermic cracking plant operator to vary his raw material.

BRIEF DESCRIPTION OF THE DRAWINGS

The present invention may be better understood, and its numerous objects and advantages will become apparent to those skilled in the art, by reference to the accompanied drawing wherein like reference numerals refer to like elements in the two figures, and in which.

DESCRIPTION OF THE DISCLOSED EMBODIMENTS

Figure 1:
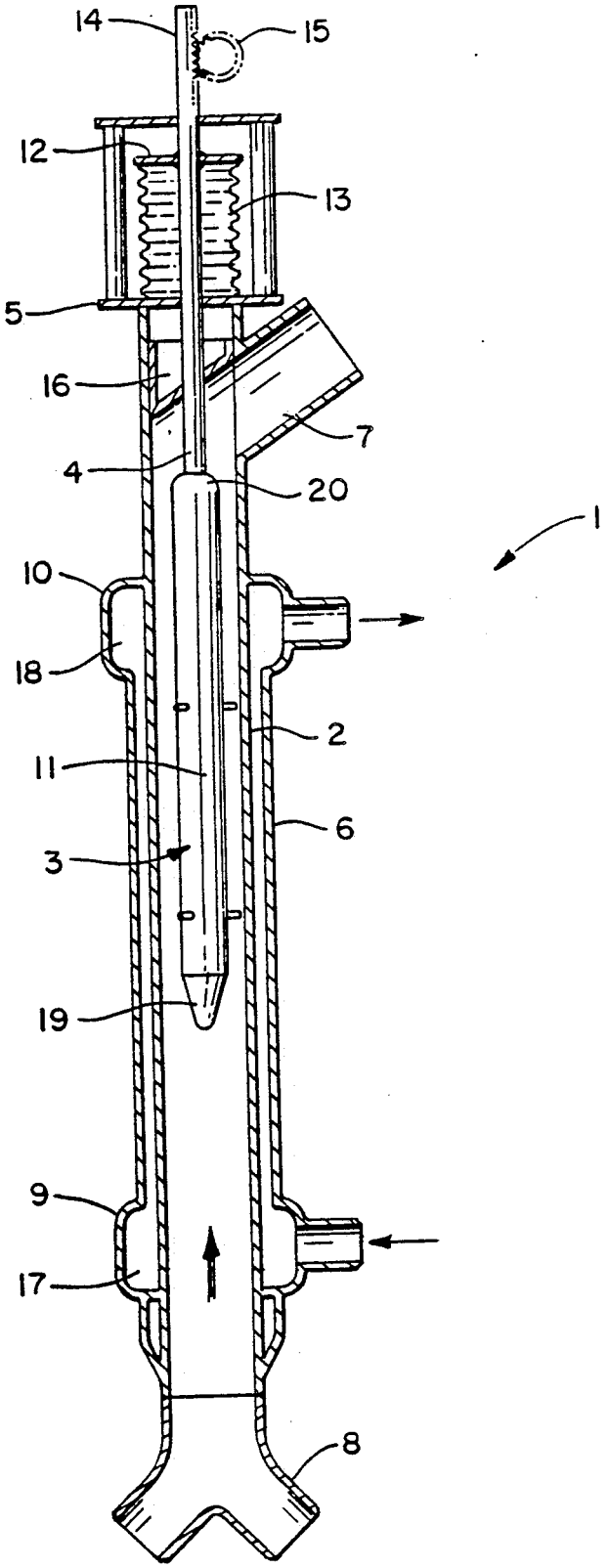
FIG. 1 is a schematic cross-sectional side elevation view of a heat exchanger in accordance with a first embodiment of the invention.

With reference now to FIG. 1, the heat exchanger indicated generally at 1 consists of an essentially straight double pipe element comprising an inner conduit 2 and an outer coaxially arranged conduit 6. The lower end of outer conduit 6 is in communication with a collector or manifold 9 while the opposite or upper end of conduit 6 terminates at a collector or manifold 10. Thus, a coolant delivered to the chamber 17 of collector 9 will flow, via the annular space between conduits 2 and 6, to the chamber 18 of collector 10. The inner conduit 2 is provided, at its upper end, with a cover plate 5. Conduit 2 is connected to an exhaust pipe, not shown, by a tubular connector 7. At its lower gas entrance end, the inner conduit 2 is coupled via a forked connector 8, to a pair of cracked gas feed pipes, not shown. In the thermic cracking environment being described, collectors 9 and 10 are respectively the water and steam ends of conduit 6.

A flow intercepting body, indicated generally at 3, is axially positionable within and coaxial with the inner conduit 2. The body 3 is supported on a guide rod 4 which extends through the cover plate 5. The guide rod 4 is provided, at its upper end, with a plate 12 which, in turn, is connected to the cover plate 5 by means of a bellows-type compensator 13. Accordingly, axial movement of guide rod 4 may be accomplished without leakage of gas from the interior of conduit 2. The guide rod 4 terminates at its upper end in a gear rack which is engaged by a drive gear 15. Accordingly, the aerodynamically shaped, i.e., streamlined, end 19 of flow intercepting body 3, which faces in the upstream direction, may be moved either in the direction of flow or against the flow to a desired position by driving rack 14. The proper axial position of the body 3 will be a function of the temperature of the gases exiting the heat exchanger via connector 7 and may be automatically controlled by means of sensing the exit gas temperature and employing the measured gas temperature to control a drive motor for gear 15. As depicted at 11, the body 3 is preferably of cylindrical shape between its upper and lower ends, respectively 20 and 19, and may be inserted a substantial distance into conduit 2 as may be seen from the drawings. The inner conduit 2 is provided with a deflection gate 16 to direct the process gases toward the connector 7, the gate 16 accomplishing a flow-economical re-direction of the gas.

Figure 2:
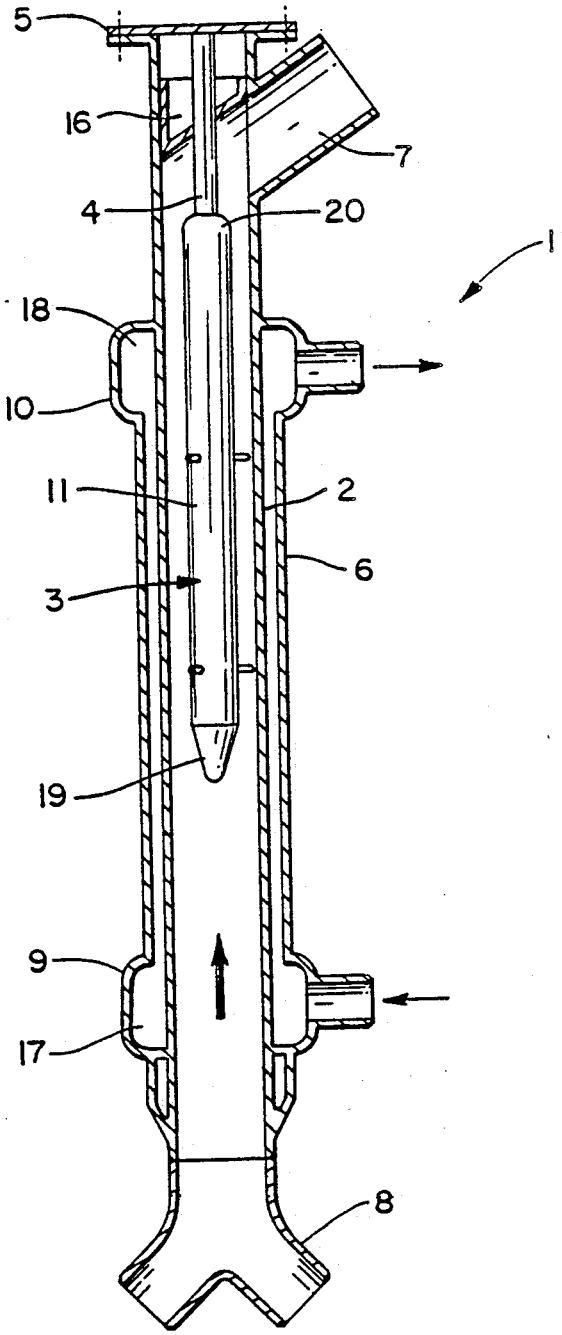
FIG. 2 is a view similar to FIG. 1 of a second embodiment of the invention.

The heat exchanger of the embodiment of FIG. 2 differs from that of FIG. 1 in that the member 3 is not axially movable. In the FIG. 2 embodiment, the adjustment of process gas exit temperature is accomplished by removing the cover plate 5 and replacing the member 3 with a member of different length. The FIG. 2 is intended for operation in an environment where there is little dirt accumulation on the heat exchange surfaces. In both embodiments, the flow intercepting body 3 will typically be a solid, fluid impervious body.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A heat exchanger comprising:

first conduit means for defining a path for the flow of a heated fluid, said first conduit means having a linear section with an axis;

second conduit means, said second conduit means defining a flow path which is at least in part linear, said linear part of said second conduit means defined flow path being arranged coaxially with the linear section of the flow path of said first conduit means, said second conduit means linear path part being positioned to the exterior of said first conduit means linear section whereby said second conduit means linear flow path part is generally of annular cross-section;

means for selecting the heat exchange characteristics of said first conduit means linear section, said heat exchange characteristic selecting means comprising an elongated fluid impervious solid body which extends a substantial distance into said first conduit means linear section, said body being positioned so as to be coaxial with said first conduit means linear section, said body cooperating with said first conduit means to define an annular flow path having a cross-sectional area which is less than the cross-sectional area of said first conduit means linear section, said annular flow path extending along at least a first part of said first conduit means linear section whereby the velocity of fluid flowing said first part will be greater than that in the remaining part of said first conduit means linear section; and means for supporting said elongate body in said first conduit means, said supporting means permitting removal and replacement of said elongated body; whereby said body can be positioned axially relative to said first conduit means to vary the length of said annular flow path.

2. The apparatus of claim 1 wherein said elongated body comprises a flow intercepting radiator member having an aerodynamically shaped free end which faces upstream in the direction of fluid flow through said first conduit means and wherein said supporting means includes means for axially varying the position of said free end of said body.

3. The apparatus of claim 2 wherein said body has a generally cylindrical shape and wherein said free end thereof is shaped to smoothly directly fluid flow about said body.

4. The apparatus of claim 3 wherein said free end shape is tapered from the said cylindrical shape to a rounded point.

5. The apparatus of claim 2 wherein said means for varying position comprises:

drive means located externally of said first conduit means,; and connecting means extending from said drive means into said first conduit means for transmitting motion produced by said drive means to said body without leakage of fluid from said first conduit means.

6. The apparatus of claim 5 wherein said body has a generally cylindrical shape and wherein said free end thereof is shaped to smoothly direct fluid flow about said body.

7. The apparatus of claim 1 wherein said elongated body has a generally cylindrical shape with a free end which faces in the upstream direction relative to fluid flow through said first conduit means, the free end of said body being aerodynamically shaped to smoothly direct fluid flow about said body.

8. The apparatus of claim 6 wherein said free end shape is tapered from the said cylindrical shape to a rounded point.

9. The apparatus of claim 7 wherein said free end shape is tapered from the said cylindrical shape to a rounded point.

10. The apparatus of claim 1 wherein said support means, is removably attached to the heat exchanger and wherein said elongated body is removably coupled to said support means.

11. A method for the adjustment of the exit temperature of a heated gas flowing through a coaxial tube heat exchanger, the heat exchanger having inner and outer tubes, comprising the steps of:

inserting a streamlined, fluid impervious flow intercepting body a substantial distance into the heat exchanger inner tube through which the heated gas passes to reduce the cross-sectional area of a portion of the inner tube and thereby increase the velocity of flow in the said reduced cross-sectional area portion of the inner tube whereby the heat exchanger is divided into sections having different heat exchange characteristics; and positioning the flow intercepting body as a function of gas exit temperature, said positioning varying the effective lengths of the different sections having different heat exchange characteristics.

12. The method of claim 11 wherein the step of inserting comprises supporting the body coaxially of the tube whereby an annular flow passage is defined, the annular flow passage being down stream of a flow passage having a circular cross-section.

* * * * *